US007044799B1

(12) United States Patent
Lai

(10) Patent No.: US 7,044,799 B1
(45) Date of Patent: May 16, 2006

(54) CARD CONNECTOR CAPABLE OF SERIATED CONTACT WITH ELECTRONIC CARD

(75) Inventor: Yaw-Huey Lai, Taipei (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/023,438

(22) Filed: Dec. 29, 2004

(30) Foreign Application Priority Data

Nov. 29, 2004 (TW) ..... 93219168 U

(51) Int. Cl.
*H01R 12/00* (2006.01)

(52) U.S. Cl. ..... 439/630

(58) Field of Classification Search ..... 439/630, 439/325, 159, 160
See application file for complete search history.

(56) References Cited

U.S. PATENT DOCUMENTS

| | | | | |
|---|---|---|---|---|
| 6,761,569 | B1 * | 7/2004 | Nakamura | 439/159 |
| 6,776,640 | B1 * | 8/2004 | Nishioka | 439/325 |
| 2005/0003711 | A1 * | 1/2005 | Chang | 439/630 |
| 2005/0095916 | A1 * | 5/2005 | Lai | 439/630 |

* cited by examiner

*Primary Examiner*—J. F. Duverne
(74) *Attorney, Agent, or Firm*—Bacon & Thomas, PLLC

(57) ABSTRACT

A card connector capable of seriated contact with an electronic card includes a shell having a plurality of contact pins each having an action portion, at least one slidable carrier having a plurality of jacking portions, and an inserting/extracting means. At least one of the action portions and the jacking portions are arranged in uneven seriation. While the card is inserted, the slidable carrier can be pushed backwards and the jacking portions jack up the action portions serially to enable the seriated contact between the contact pins and corresponding terminals of the card.

6 Claims, 7 Drawing Sheets

CARD CONNECTOR CAPABLE OF SERIATED CONTACT WITH ELECTRONIC CARD

BACKGROUND OF THE INVENTION

1. Field of the Invention

The present invention relates generally to electronic devices, and more particularly to a card connector capable of seriated contact with an electronic card.

2. Description of the Related Art

A conventional card connector is comprised of a shell and a plurality of contact pins provided for electrical contact with corresponding terminals of an inserted card for conversional connection of signals. As we are aware, while a commercially available memory card is inserted into the card connector, the corresponding terminals of the card have to be in seriated contact with the contact pins of the card connector, e.g. the contact with the power and grounding terminals has to be done before the contact with the signaling terminals. In the design of the contemporary card connector, the contact pins of the card connector are generally disposed in uneven seriation corresponding to the unevenly seriated corresponding terminals of the card, such as the SD (secure digital) card or the MS (memory stick) card.

Although the aforesaid design can attain the requirement of seriated contact between the corresponding terminals of the card and the contact pins of the card connector, the corresponding terminals disposed in some kinds of cards, such as XD (extreme digital) card, are positioned side by side and fail to be effectively in seriated contact with the seriated contact pins of the card connector.

SUMMARY OF THE INVENTION

The primary objective of the present invention is to provide an improved card connector, which contact pins can be in seriated contact with corresponding terminals of an inserted card.

The foregoing objective of the present invention is attained by the improved card connector, which is comprised of a shell, at least one slidable carrier, and an inserting/extracting means. The shell includes an opening defined at its front end and a plurality of contact pins mounted at its bottom side. Each of the contact pins has an action portion at a predetermined position thereof. The slidable carrier is located in the shell, having a driven portion for pushing by an inserted card to push the slidable carrier to slide backwards, a plurality of slots formed at its bottom side for extending through by the contact pins, a plurality of jacking portions respectively at front ends of the slots, and a plurality of pressing portions respectively at rear ends of the slots. The action portions of the contact pins correspond respectively to the jacking portions. At least one of the action portions and the jacking portions are arranged in uneven seriation. The inserting/extracting means is mounted between the shell and the slidable carrier for keeping the slidable carrier located at an inserting position and an extracting position.

DETAILED DESCRIPTION OF PREFERRED EMBODIMENTS

Figure 1:
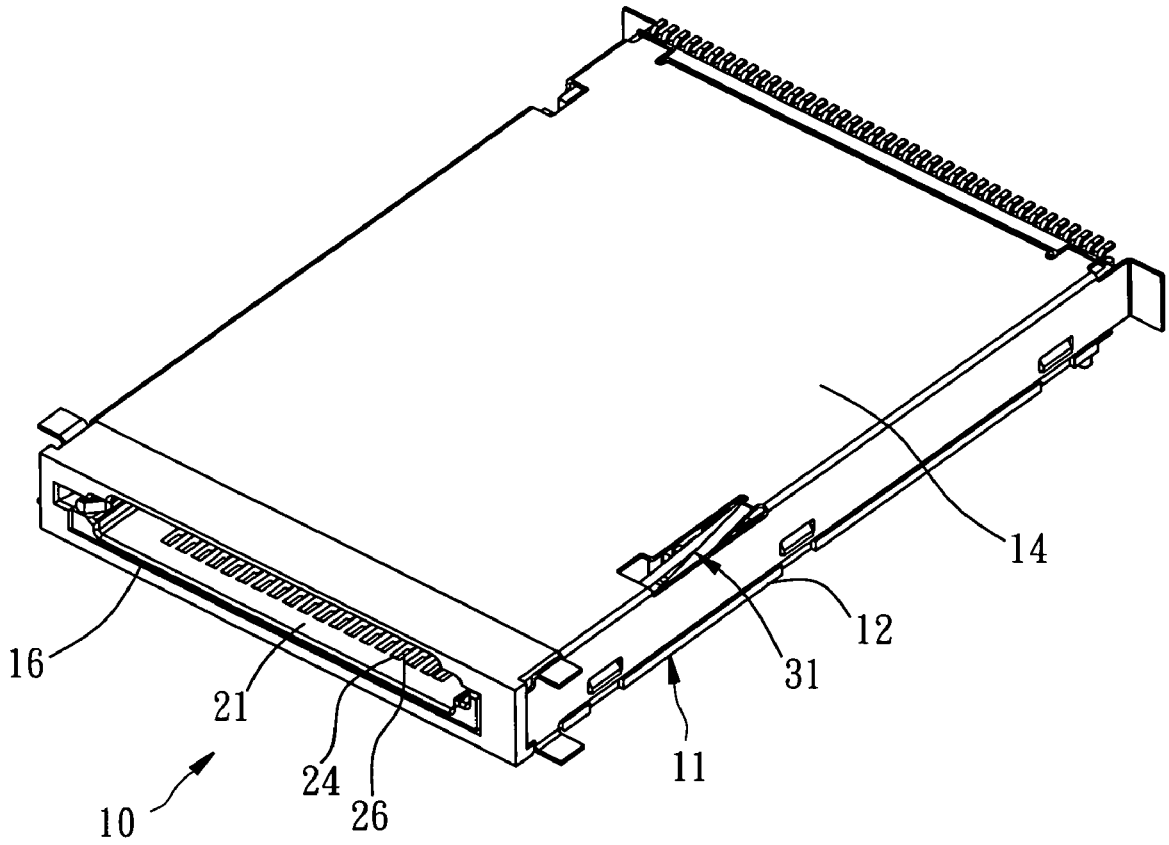
FIG. 1 is a perspective view of a first preferred embodiment of the present invention.
Figure 2:
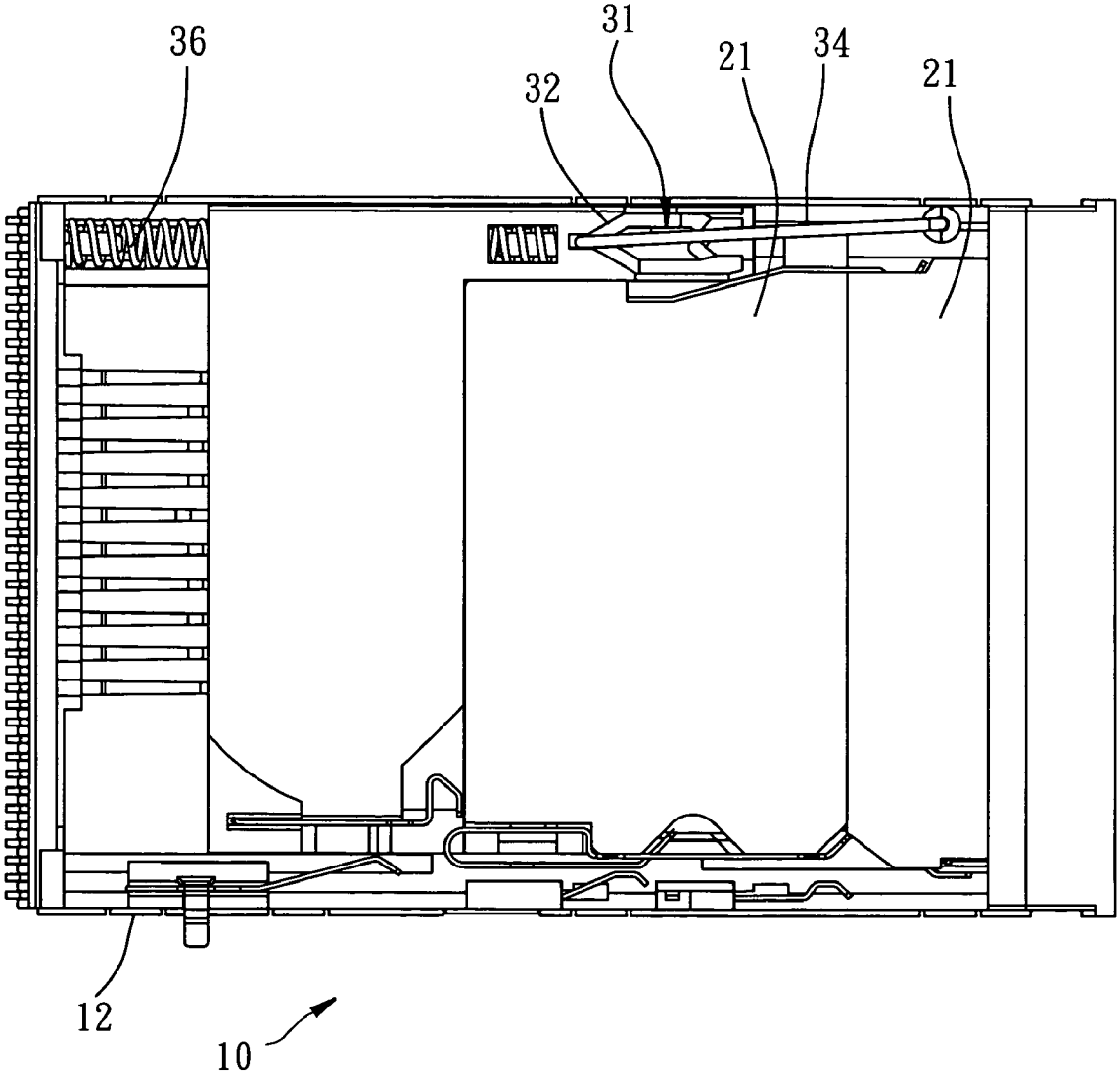
FIG. 2 is a top view of the first preferred embodiment of the present invention, which cover is removed.

Referring to FIGS. 1–5, a card connector 10 constructed according to a first preferred embodiment of the present invention is comprised of a shell 11, at least one slidable carrier 21, and an inserting/extracting means 31.

The shell 11 includes a base 12 and a cover 14, defining an opening at a front end thereof. The base 12 has a plurality of contact pins 18, each of which defines an action portion 19 at a predetermined position thereof.

There are two slidable carriers 21 defined as a front slidable carrier and a rear slidable carrier in this embodiment. The slidable two carriers 21 are mounted in the shell 11 for passing through by a relatively narrower or thinner card 91. Each of the slidable carriers 21 includes a driven portion 22 for pushing by the card 91 to further push the slidable carrier 21 to slide backwards while the card 91 is inserted. A plurality of slots 24 are formed at a bottom side of each slidable carrier 21 for extending therethrough by the contact pins 18, each defining a jacking portion 26 at a front end thereof and a pressing portion 28 at a rear end thereof. The jacking portions 26 are arranged in uneven seriation, each corresponding to the action portion 19 of each contact pin 18, wherein the action portions 19 are uniformly arranged side by side.

The inserting/extracting means 31 includes a heart-shaped guide groove 32, a positioning member 34, and a spring 36, for keeping the slidable carriers 21 located at an inserting position while the slidable carrier 21 is pushed and for contacting against the slidable carrier 21 to push the slidable carrier 21 toward an extracting position and keep the slidable carrier 21 located at the extracting position while the slidable carrier 21 is pushed again for extraction. The guide groove 32 is located at the rear slidable carrier 21. The positioning member 34 has two ends mounted respectively to the base 12 and in the guide groove 32. The spring 36 has two ends contacting respectively against the base 12 and the rear slidable carrier 21, for generating resilience that pushes the slidable carrier 21 outwards. Since the inserting/extracting means 31 is well known as prior art and is an insignificant feature of the present invention, no further recitation is necessary.

Figure 3:
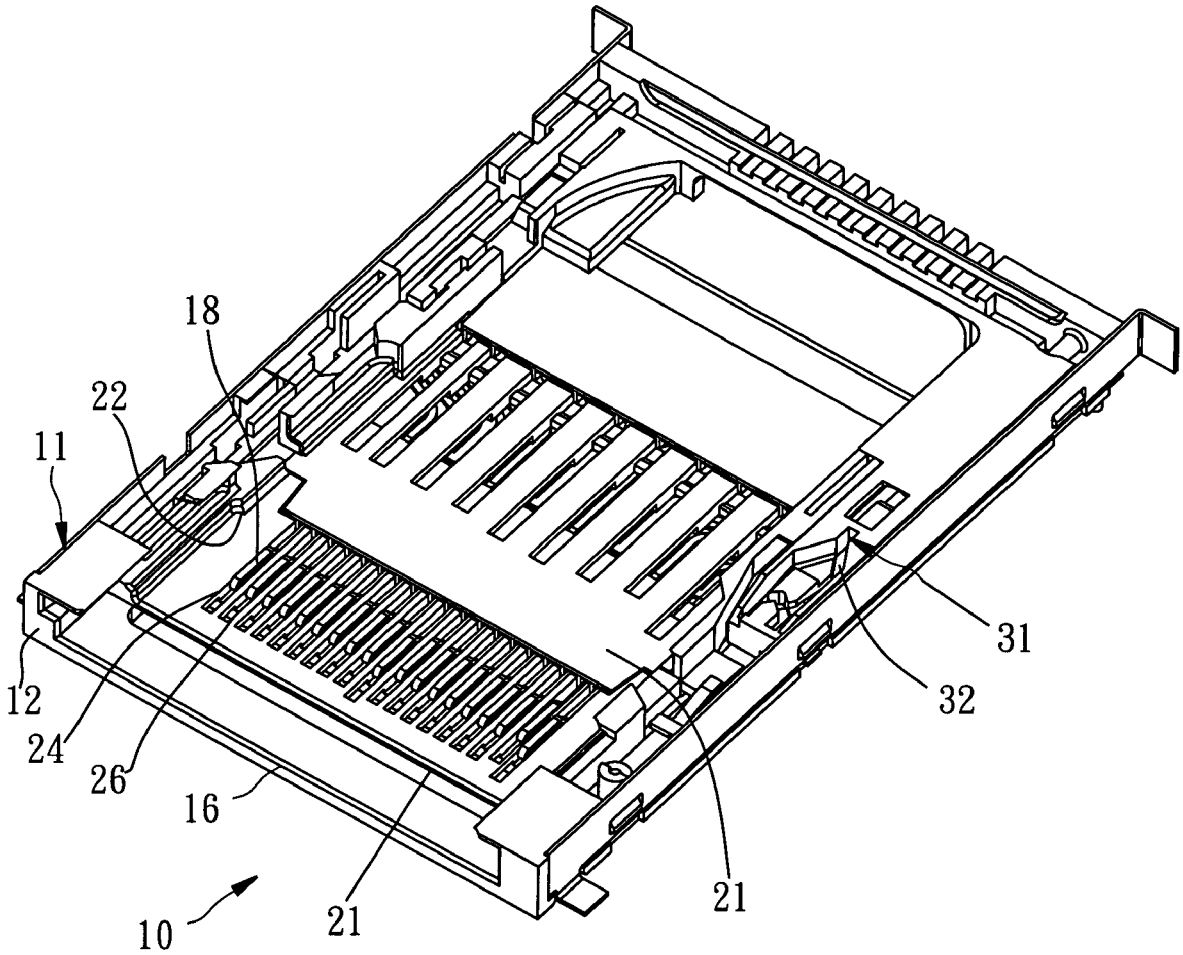
FIG. 3 is a perspective view of the first preferred embodiment of the present invention, which cover is removed.
Figure 4:
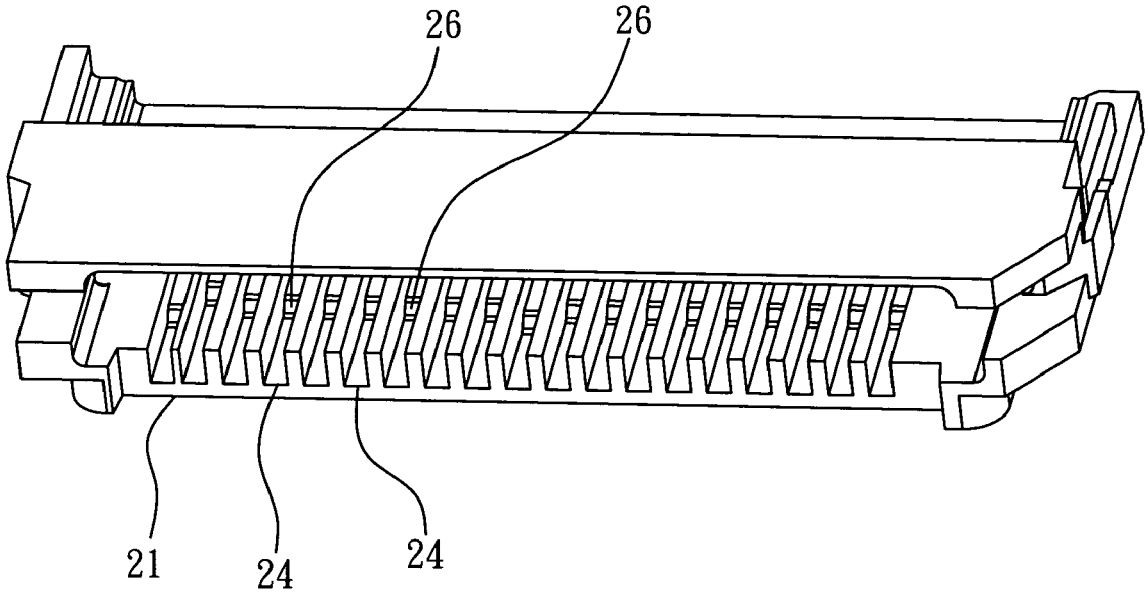
FIG. 4 is a partial enlarged view of the first preferred embodiment of the present invention.
Figure 5:
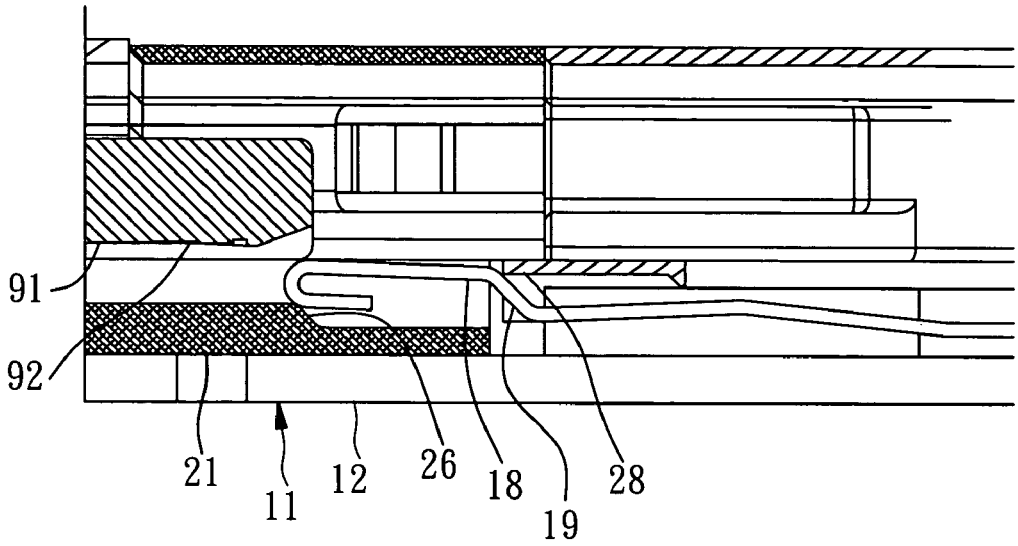
FIG. 5 is a partial sectional view of the first preferred embodiment of the present invention in operation, showing that a card is entering the card connector.
Figure 6:
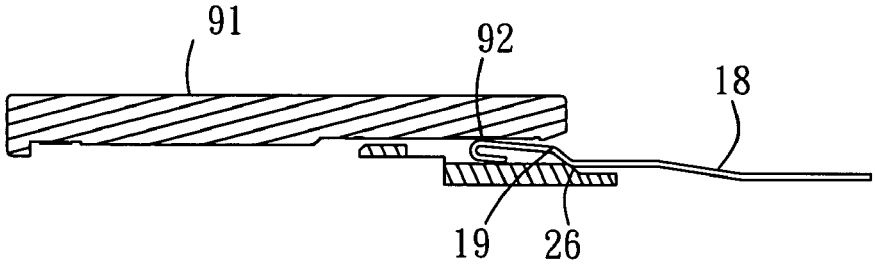
FIGS. 6(A)–(C) show that different contact pins of the first preferred embodiment of the present invention are in differently seriated contact with the corresponding terminals of the card.
Figure 6:
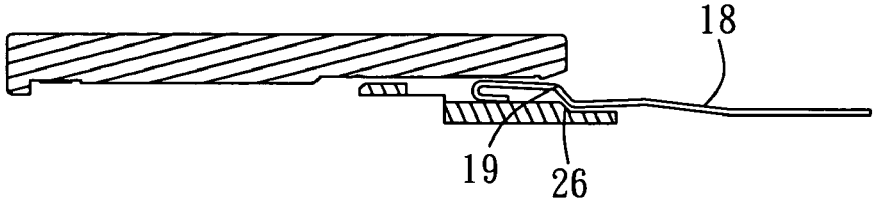
Figure 6:
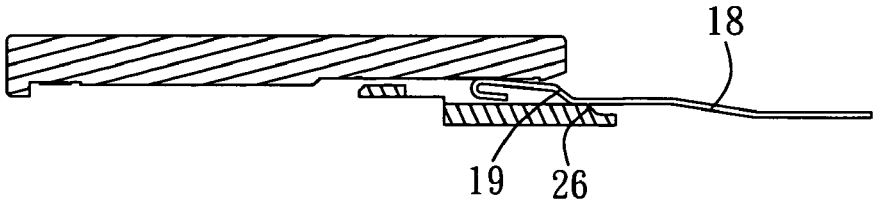

Referring to FIGS. 3 and 5–6, while the card 91 is inserted, the card 91 contacts against the driven portion 22 to push the slidable carriers 21 backwards. While the slidable carriers 21 are pushed backwards, the jacking portions 26 contact respectively against the action portions 18 of the contact pins 18 to jack up the contact pins 18 and further enable the contact pins 18 to contact the corresponding terminals 92 of the card 91 in uneven seriation. Push the card 91 once again to trigger the inserting/extracting means 31 to push the slidable carriers 21 outwards. While the slidable carriers 21 are pushed outwards, the pressing portions 28 press the contact pins 18 downwards and the card 91 is extracted at the same time.

Figure 7:
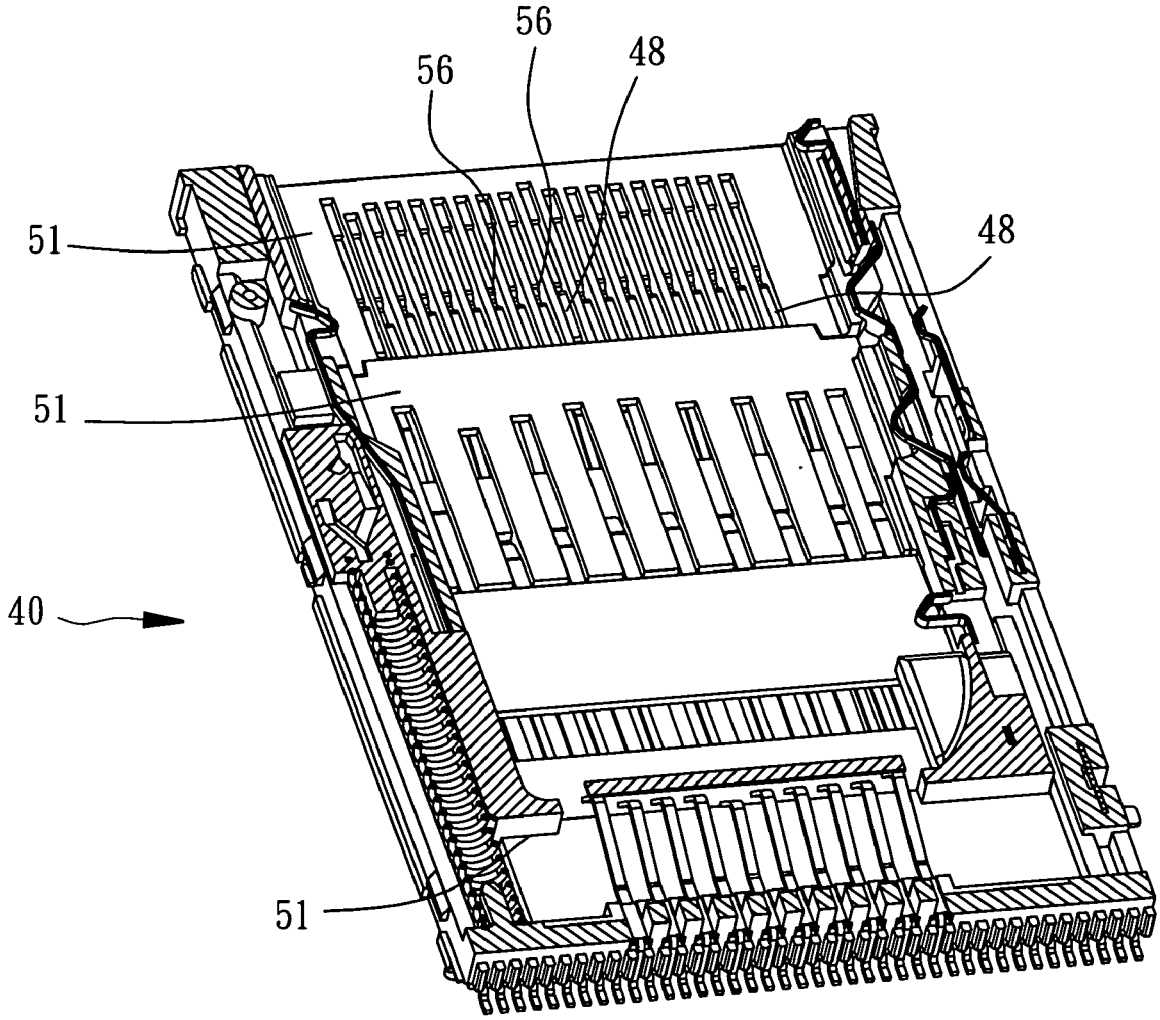
FIG. 7 is a perspective view of a second preferred embodiment of the present invention, which cover is removed.
Figure 8:
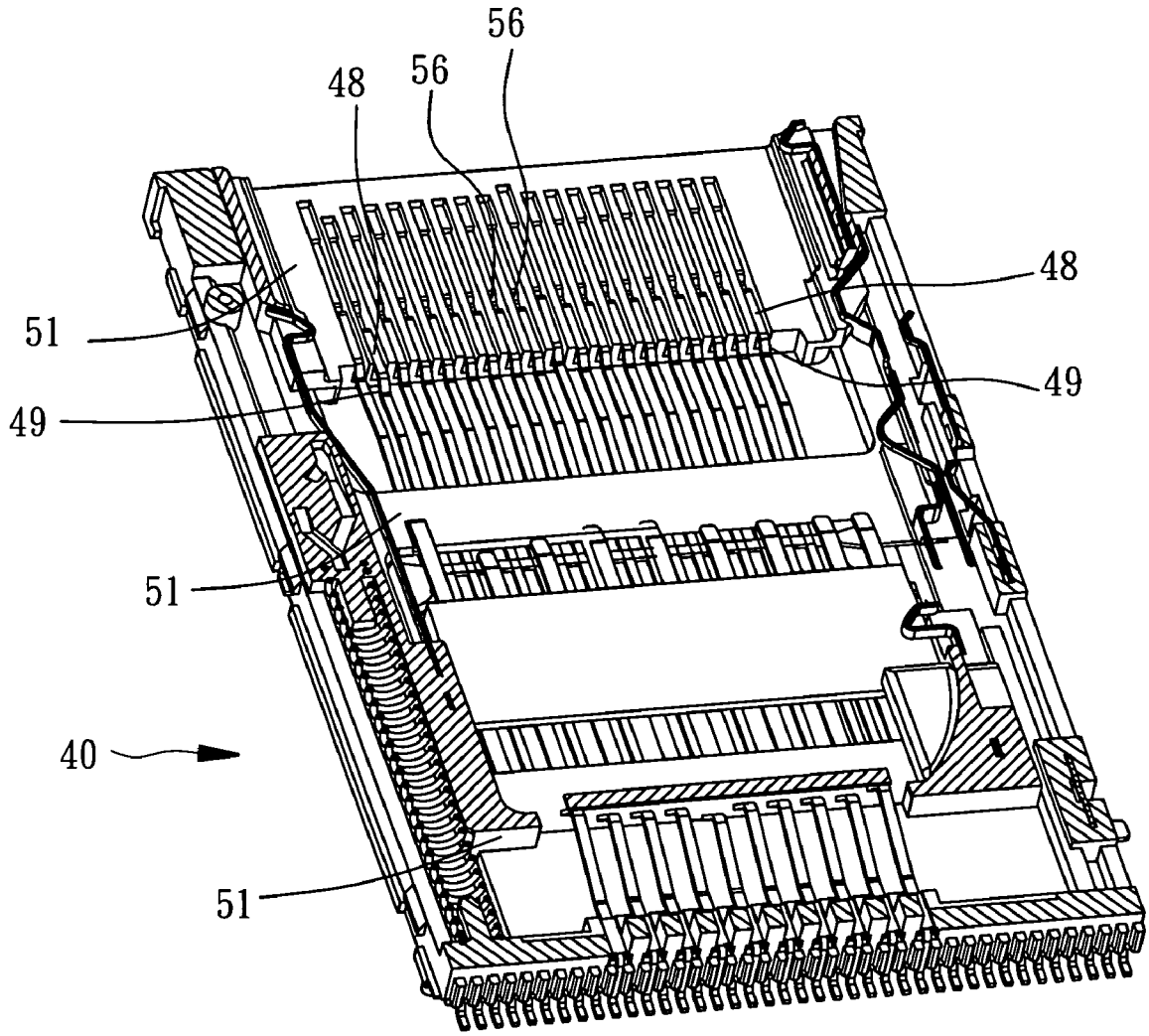
FIG. 8 is another perspective view of the second preferred embodiment of the present invention, which cover is removed.

Referring to FIGS. 7–8, the card connector 40 constructed according to a second preferred embodiment of the present invention is similar to the aforesaid embodiment but different by that the shell 41 includes three slidable carriers 51 therein, one of which is located abutting the opening of the base and has its jacking portions 56 uniformly arranged side by side, and the contact pins 48 are arranged in uneven seriation. The operation of the second embodiment is identical to the aforesaid embodiment, such that further recitation of the operation of the second embodiment is skipped.

It is to be noted that the slidable carrier of the present invention can be alternatively any in number. Further, both of the jacking portions of the slidable carrier and the action portions of the contact pins can alternatively be arranged in uneven seriation.

In conclusion, the present invention includes advantages of jacking up the contact pins by the jacking portions and further causing the seriated contact between the contact pins and the corresponding terminals of the card.

What is claimed is:

1. A card connector comprising:

a shell having an opening defined at its front end and a plurality of contact pins mounted at its bottom side, said contact pins each having an action portion;

at least one slidable carrier located in said shell and having a driven portion for pushing by an inserted card to push said slidable carrier to slide backwards, said slidable carrier having a plurality of slots at its bottom side, said contact pins extending through said slots and into said shell, said slidable carrier having a plurality of jacking portions respectively at front ends of said slots and a plurality of pressing portions respectively at rear ends of said slots, said action portions of said contact pins corresponding respectively to said jacking portions, at least one of said action portions and said jacking portions being arranged in uneven seriation; and an inserting/extracting means mounted between said shell and said slidable carrier for keeping said slidable carrier located at an inserting position and an extracting position, wherein pushing of a card into said at least one slidable carrier causes said jacking portions to engage said action portions of said contact pins and cause said contact pins to engage the card in uneven seriation.

2. The card connector as defined in claim 1, wherein said shell comprises a base and a cover.

3. The card connector as defined in claim 1, wherein said jacking portions of said slidable carrier are arranged in uneven seriation; said action portions are uniformly arranged side by side.

4. The card connector as defined in claim 1, wherein said jacking portions of said slidable carrier are uniformly arranged side by side; said action portions are arranged in uneven seriation.

5. The card connector as defined in claim 1, wherein said jacking portions of said slidable carrier and said action portions of said contact pins are totally arranged in uneven seriation.

6. The card connector as defined in claim 1, wherein said inserting/extracting means comprises a heart-shaped groove, a positioning member, and a spring.

* * * * *